US006032938A

United States Patent [19]

Jones

[11] Patent Number: 6,032,938

[45] Date of Patent: Mar. 7, 2000

[54] CARVER'S VISE

[75] Inventor: Steve K. Jones, Nepean, Canada

[73] Assignee: Lee Valley Tools Ltd., Ottawa, Canada

[21] Appl. No.: 09/141,653

[22] Filed: Aug. 28, 1998

[51] Int. Cl.[7] ..... B25B 1/22

[52] U.S. Cl. ..... 269/64; 269/71

[58] Field of Search ..... 269/71, 73, 64, 269/95, 101, 82

[56] References Cited

U.S. PATENT DOCUMENTS

| | | | |
|---|---|---|---|
| 530,427 | 12/1894 | Kendig | 269/64 |
| 1,305,321 | 6/1919 | Tooker | 269/71 |
| 1,392,130 | 9/1921 | Engstrom et al. | 269/64 |
| 1,529,251 | 3/1925 | Hansen | 269/71 |
| 1,611,305 | 12/1926 | Ellwood | 269/64 |
| 3,881,888 | 5/1975 | Schwab | 269/71 |
| 4,500,077 | 2/1985 | Coxon | 269/82 |
| 4,502,457 | 3/1985 | Marron | 269/71 |

OTHER PUBLICATIONS

Two (2) photographs of R.T.F. Designs, Ltd. Vise. (admitted prior art).

Four(4) photographs of Record Carver's Vise. (admitted prior art).

*Primary Examiner*—Robert C. Watson

*Attorney, Agent, or Firm*—John S. Pratt; Kilpatrick Stockton LLP

[57] ABSTRACT

A carver's vise for holding a workpiece to be carved includes a base mounted to a workbench, a clamp mechanism, a mounting plate, and a mounting plate shaft clamped to a base connector by the clamp mechanism. The base includes an angled portion that extends upwardly from a rear of the base to a point near the front of the base closer to the user. The clamp mechanism includes a clamp head holding the mounting plate shaft against the base connector, a clamp shaft located in a bore of the base connector, and a handle that tightens or releases the clamp from the base connector. When the handle releases the clamp head, the mounting plate is free to rotate about the clamp shaft. Grooves in the base connector and an O-ring allow the mounting plate to rotate in discrete angular increments. The mounting plate may also rotate about the clamp shaft and move back and forth through the clamp head.

13 Claims, 4 Drawing Sheets

CARVER'S VISE

BACKGROUND OF THE INVENTION

1. Field of the Invention

This invention is directed to carving accessories and, more particularly, to a vise for holding a workpiece to be carved.

2. Background

Carving is a reductive process; a carver cuts wood away to create something useful or decorative. The principal forms of woodcarving are relief carving and carving in the round. A relief carving is intended to be viewed from one side and so is nearly always carved from a flat board or relatively thin stock. The technique is used for embellishing furniture and wall panels, and for creating nonfunctional works of art. A carving in the round is fully three-dimensional and is meant to be seen from all sides.

Carving in the round involves selecting and setting up a block of wood. The carver affixes a vise to a workbench and then places the workpiece in the vise. The carver uses a variety of carving chisels and gouges to cut away a rough shape of the final design. Smaller tools are then used to refine the shape and set in the detail. The figure may be smoothed using rifflers and fine sandpaper.

Woodcarving employs very sharp tools that are either pushed or driven through the wood. It is, therefore, essential for accurate and safe work that the workpiece be held firmly. Carvers have a range of available devices for holding their work. One of the most common vises for carving is the engineer's vise. The engineer's vise is a metalworking vise employed for woodcarving. The vise uses "soft jaws" since metal jaws will mark the wood unless the work has a waste area that can be gripped in the vise.

Another commonly used vise is the conventional carver's vise. A conventional carver's vise is similar in principle to an engineer's vise but is made of wood. Also, the jaws of the conventional carver's vise are deeper and are lined with cork or leather to protect the work. A single bench screw may be used to hold the vise on the bench. This allows the vise to be swiveled to various angles about the screw.

Neither the carver's vise nor the engineer's vise allow the carver to quickly alter the angle of the work. For both vises, the jaws of the vise must be removed from the workpiece to swivel the workpiece at an angle. To overcome this problem, carver's often use a pivoting clamp. The pivoting clamp includes a pivoting head mounted within a base that allows the work to be set at an angle and securely locked into position. The pivoting head can be fitted with different-sized faceplates to suit the size of the work.

None of these devices, however, permit quick rotation and/or translation of the workpiece. The engineer's vise requires its jaws to be released before the workpiece may be rotated. Moreover, the engineer's vise offers no rotation around the workpiece nor any translation of the workpiece vertically. Like the engineer's vise, the carver's vise requires its jaws to be released before the workpiece may be rotated, and also offers no up-and-down translation of the workpiece. The pivoting clamp permits rotation about two axes, but the angular rotation is limited by the size of the base and the workpiece may not move vertically.

With limited workbench space in many carver's workshops, mounting a vise on top of the workbench may not be an option. Therefore, a carver may often desire to mount the vise to the side of the workbench. When side-mounted to a workbench, the engineer's vise still allows rotation of the workpiece about a single axis if the jaws are released. The carver's vise, however, loses an axis of rotation since the vise cannot be supported in mid-air by the single bench screw. The pivoting clamp becomes extremely ineffective as the angular limitation becomes more pronounced. The pivoting head of the clamp (and, therefore, the workpiece) protrude from the side of the workbench. Thus, the clamp may not be rotated to hold the workpiece in an upright position.

SUMMARY OF THE INVENTION

To overcome the problems of previous vises, this invention is a vise that may be angled toward the user to allow easier access to the workpiece. In addition, the vise includes a releasable clamp mechanism that allows the workpiece to be quickly rotated and adjusted in several directions. This vise of the present invention allows the carver to easily manipulate the vise and the workpiece to achieve a desired position.

In a preferred embodiment, this vise includes a base, a clamp mechanism, and a workpiece mounting plate attached to the clamp mechanism by a shaft. The base includes a portion mounted to a workbench or similar work table. The base further includes an angled portion that extends from a rear of the base upwardly toward the front of the base. The angled portion of the base positions the workpiece closer to the user for easier access and positioning. The curve in the base also allows the vise to be mounted on top of the workbench or along a side of the workbench if benchtop space is limited. The angled portion may be further reinforced by a series of ribs extending along either side of the base. A central rib down both sides provides additional strength and support to the base.

The clamp mechanism is attached to the base by a cylindrical base connector. The base connector is integrally formed with the base and includes a bore for receiving a clamp shaft. The clamp mechanism includes the clamp shaft, a clamp head attached to the clamp shaft, and a handle that tightens and releases the clamp head from the base connector. The clamp shaft is threaded and engages a tapped bore located within a bore of the handle. The clamp head holds the mounting plate shaft in position. When the handle is rotated on the threaded clamp shaft, the handle and shaft draw the clamp head and mounting plate shaft against the base connector. This quickly locks the mounting plate and the affixed workpiece in position.

When the handle is rotated in the opposite direction, the clamp head is released from the base connector. When released, the clamp head is free to rotate the longitudinal axis of the clamp shaft. To facilitate the quick rotation of the clamp head about the clamp shaft axis and provide numerous "tilted" positions at which the mounting plate shaft may be locked, the base connector includes radial grooves. Each groove is preferably located a discrete angular distance, such as 30 degrees, away from the previous groove. As the clamp head is rotated, the mounting plate shaft easily slides from one groove into another, thereby allowing the user to rotate the workpiece to various positions quickly and accurately. A spring surrounding the clamp shaft provides positive feedback to the user regarding the position of the mounting plate shaft within a groove. To prevent the clamp head and mounting plate shaft from rotating uncontrollably, an O-ring bears against the mounting plate shaft.

In the released position, the mounting plate may also rotate about the longitudinal axis of the mounting plate shaft. This allows the user to quickly access the front, sides, and rear of the workpiece. Finally, the mounting plate may move along the plate shaft longitudinal axis to adjust the height of the workpiece with respect to the vise.

The rotation and translation capabilities of the mounting plate and the shape of the base allow the vise to be mounted to the top or side of the workbench. When the vise is mounted atop the workbench, the angled shape brings the workpiece closer to the user. The user may easily rotate the mounting plate to carve various parts of the workpiece. When the vise is mounted along a side of the workbench, the base may now angle upwardly toward the user. In addition, the rotation of the mounting plate about the clamp shaft allows the user to place the workpiece in a more upright and comfortable position. The user may then rotate the mounting plate around the mounting plate shaft and/or through the clamp head until he locates a desirable position for the workpiece.

Accordingly, it is an object of the present invention to provide a sturdy carver's vise.

It is another object of the present invention to provide a carver's vise that offers greater access to the workpiece.

It is a further object of the present invention to provide a carver's vise that allows the workpiece to be quickly and accurately rotated to various positions.

It is yet another object of the present invention to provide a carver's vise that may be mounted to the top of a workbench.

It is an additional object of the present invention to provide a carver's vise that may be mounted to the side of a workbench and still permit access to various sides of the workpiece.

Additional objects and advantages of the invention will be set forth in part in the description which follows and in part will be obvious from the description or may be learned by practice of the invention. The objects and advantages of the invention will be realized and attained by means of the elements and combinations particularly pointed out in the appended claims.

DETAILED DESCRIPTION

Reference will now be made in detail to a preferred embodiment of the invention, examples of which are illustrated in the accompanying drawings. Wherever possible, the same reference numbers will be used throughout the drawings to refer to the same or like parts.

Figure 1:
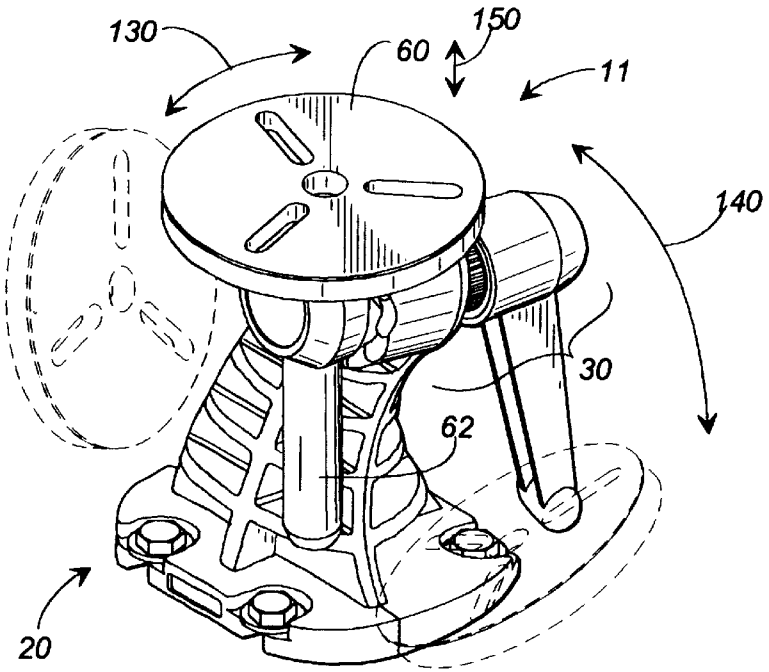
FIG. 1 is a front perspective view of a carver's vise, according to a preferred embodiment of the present invention.

FIG. 1 is a front perspective view of a carver's vise 1. The vise 11 is designed for holding a workpiece (not shown) to be carved. The vise 11 includes a base 20, a clamping mechanism 30 coupled to the base, and a mounting plate 60 coupled to the clamping mechanism 30 by a mounting plate shaft 62. The vise 11 may be attached to the top or sides of a workbench, as described in greater detail below.

Figure 2:
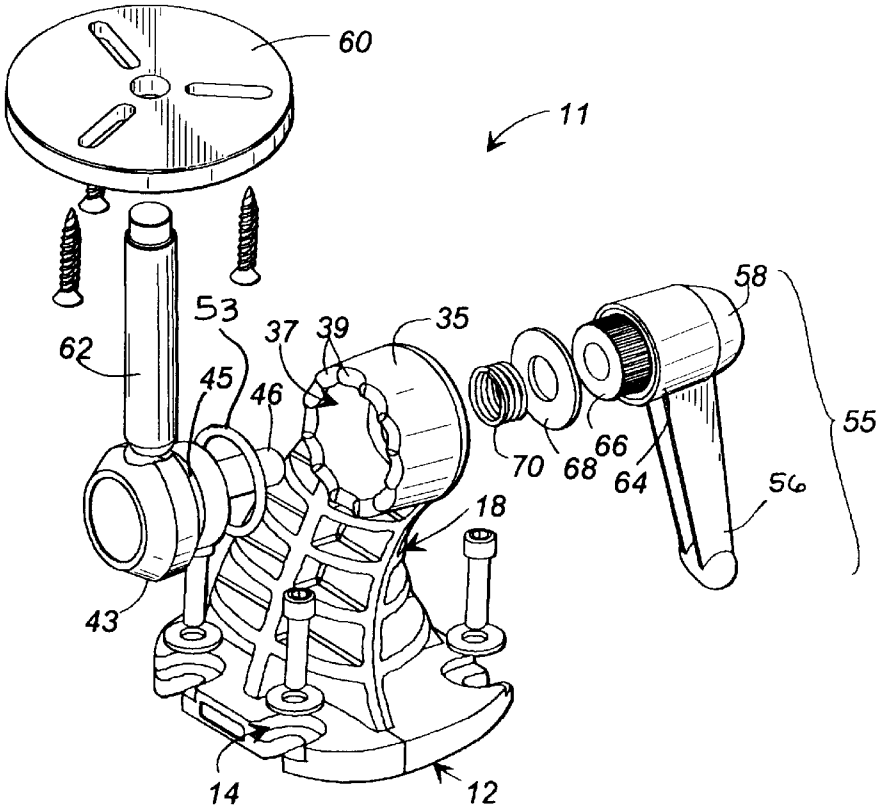
FIG. 2 is an exploded view of the vise illustrated in FIG. 1.

FIG. 2 is an exploded view of the vise 11. Preferably, the base 11 is a rigid casting of zinc-aluminum alloy, although other metals of sufficient strength may be used. The base 20 of the vise 10 includes a rigid mounting portion 12 for coupling the base 20 to a workbench or other accessory. The mounting portion 12 is formed in the semi-oval shape illustrated in FIG. 2, although other shapes and sizes may be used. A plurality of recesses 14 formed into the mounting portion 12 receive fasteners and washers. Bolts and other fasteners may also be used to rigidly attach the base 20 to a workbench. The mounting portion 12 further includes a tapped bore 17 (see FIG. 9) disposed orthogonally to the lower surface of the base 20. The bore 17 is designed to receive a threaded rod engaging a hole in the workbench.

Figure 3:
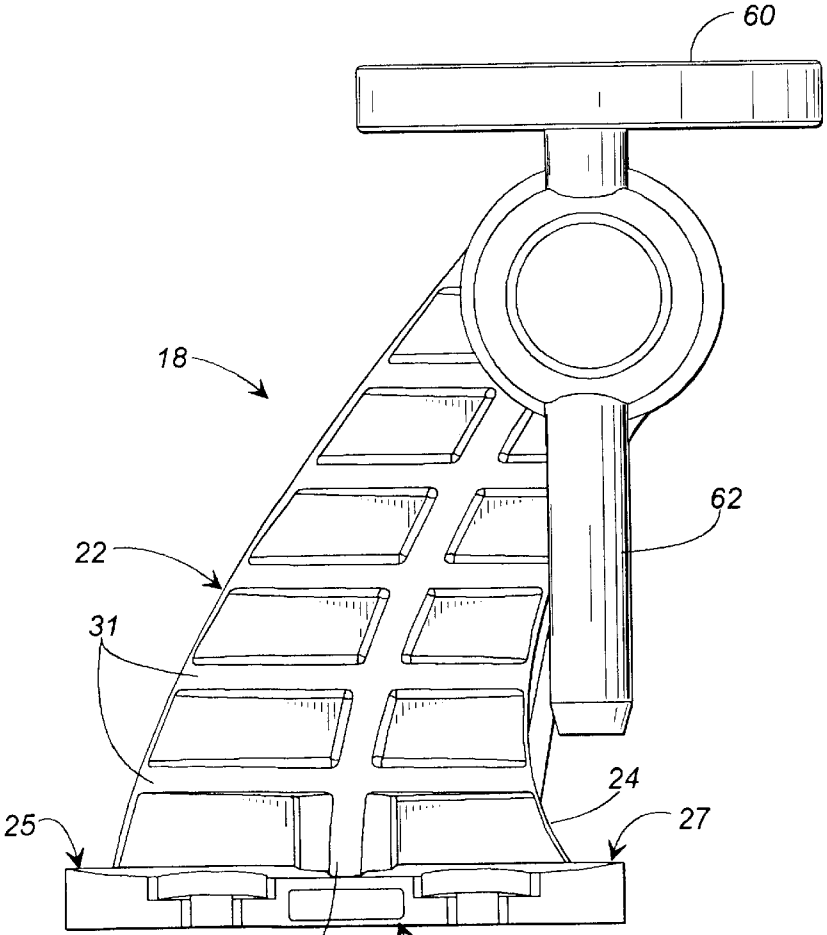
FIG. 3 is a side view of the vise illustrated in FIG. 1.

The base 20 further includes an angled portion 18 formed integrally with the mounting portion 12. The angled portion 18 angles the base forward from the mounting portion to a position located closer to the front of the vise 11 near the user. As illustrated in FIG. 3, a rear surface 22 of the angled portion 18 extends upwardly from a rear section 25 of the mounting portion 12 to a position lying above a front section 27 of the mounting portion. A front surface 24 of the angled portion 18 is slightly concave so as to support the angled portion 18 of the base 20. To provide additional support, the angled portion 18 also includes a plurality of ribs 31 extending along first and second sides. The ribs 31 are connected by a central rib 34 extending along both sides of the angled portion 18 and having a shape similar to the rear surface 22. Although the angled portion 18 is designed to strengthen the base 20, it should be apparent to one of ordinary skill in the art that the angled portion 18 and the mounting portion 12 may have many different designs. Any design, however, should angle the base forward from the workbench to present the workpiece closer to the user.

Figure 4:
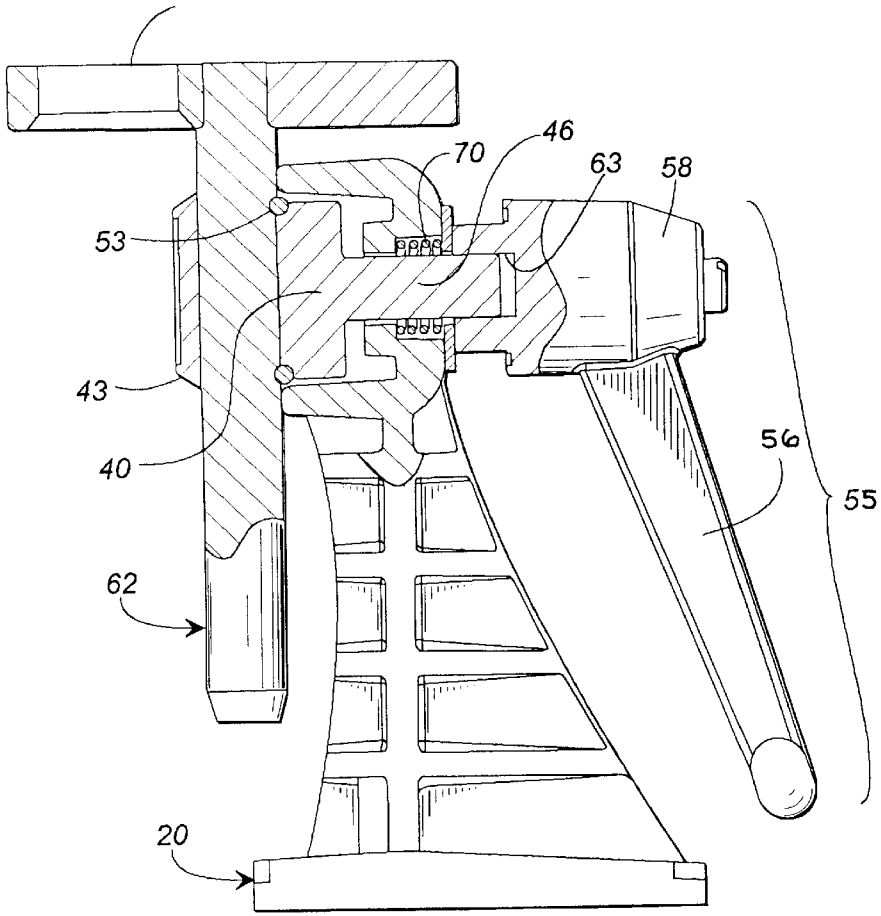
FIG. 4 is a side view of the vise with a cut-away view of the clamp mechanism.

With continuing reference to FIG. 2 and examining FIG. 4, the clamping mechanism 30 will now be described. FIG. 4 illustrates the clamping mechanism 30 in a cut-away view. The clamping mechanism 30 secures the mounting plate at a plurality of angles. The clamping mechanism 30 includes a base connector 35, a clamp 40 having a clamp shaft 46, and a handle 55. The base connector 35 is formed integrally with the base and is preferably semi-cylindrical in shape. A plurality of semi-circular grooves 39 are formed along the circumference of an one surface of the base connector 35. The grooves 39 are preferably spaced to allow the mounting plate shaft 62 to rotate in discrete 30° increments around the clamp shaft 46. The grooves 39 receive an outer surface of the mounting plate shaft 62. A bore 37 within the base connector permits passage of the clamp 40 therethrough.

Figure 5:
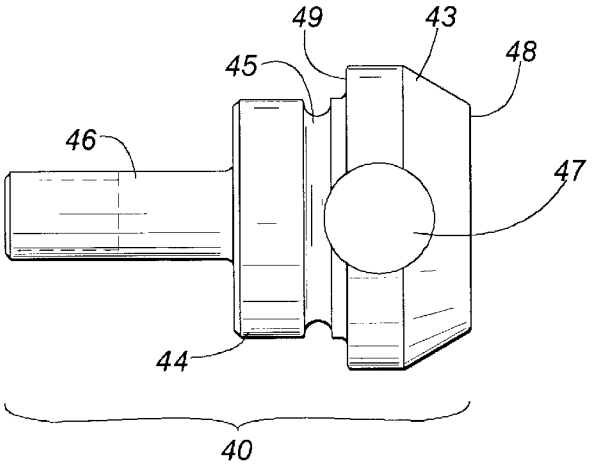
FIG. 5 is a side view of the clamp illustrated in FIG. 2.

The clamp 40 is shown in greater detail in FIG. 5. As shown, the clamp 40 includes a semi-cylindrical head 43. The head 43 tapers outwardly from a first diameter near an outside surface 48 of the shaft head 43 to a second, larger diameter proximate an inside surface 49 of the shaft head 43. A cylindrical bore 47 in the head 43 receives a mounting plate shaft 62 at an angle perpendicular to the clamp 40. As discussed below, the mounting plate 60 may be rotated about an axis passing through the shaft. When rotated as such, the mounting plate shaft 62 remains perpendicular to the clamp 40.

A cylindrical intermediate section 44 couples the clamp head 43 to the clamp shaft 46. The intermediate section 44 includes an O-ring groove 45 formed around its circumference. The O-ring groove 45 receives an O-ring 53 (see FIG. 2). The O-ring 53 is a rubber or elastomer ring that fits tightly within the O-ring groove 45. The O-ring groove 45 is formed such that the O-ring makes slight contact with an outer surface of the mounting plate shaft 62.

To lock the clamp 40 and mounting plate 60 into a desired position, the clamping mechanism 30 includes a spring-loaded gyratory clamp handle 55. The clamp handle 55 is a plastic member that rotates around the clamp shaft 46 of the clamp 40. The handle 55 includes a hub 58 and a grip 56 formed integrally with the hub 58. The grip 56 extends from the hub at an angle to prevent the user's fingers from striking the base 20 when turning the handle 55. The hub 58 includes a central bore 63 that is tapped to receive the threaded clamp shaft 46. The hub 58 may be composed of an outer section 64 and a removable inner section 66. The inner section 66 containing the central bore 63 may be releasably coupled to the outer section 64 by a screw, a bolt, or other fastening mechanisms. The outer section 64 may rotate about the inner section 66 when the hub 58 is moved away from the base connector 35. The inner section 66 may further include a plurality of serrations along its outer circumference that engage grooves formed along the interior of the outer section.

A spring 70 or other energy storing mechanism fits loosely over the threads of the clamp shaft 46. The spring 70 engages a surface of the inner section 66. A washer 68 may also be placed between the base connector 35 and the inner section 66 of the hub 58. It should be apparent that the handle 55 may have shapes and sizes other than those depicted in the figures.

The clamp 40 may be tightened by rotating the handle 55 such that the handle 55 moves closer to the base connector 35. As the handle moves closer, the tapped bore 63 engages the threads on the clamp shaft 46, thereby drawing the clamp head 43 closer to the base connector 35. As the clamp head 43 draws closer to the base connector 35, the mounting plate shaft 62 is also drawn toward the base connector 35. When the clamp 40 is fully tightened, the head 43 and the mounting plate shaft 63 are locked into position. Neither the clamp 40 nor the mounting plate shaft 62 may rotate or translate while in this locked position. When the handle is rotated away from the base connector, the clamp head 43 is released from its position.

The gyratory clamp handle 55 may also be rotated to various positions without tightening or loosening the clamp 40. Specifically, when the outer section 64 of the hub 58 is moved away from the base connector 35, the outer section 64 may be rotated about the inner section 66. This allows the handle 55 to be moved to more desirable and less cumbersome positions with respect to the vise. The serrations along the circumference of the inner section 66 provide positive stops for the outer section 64 to engage when the hub is moved back towards the base connector 35.

Figure 6:
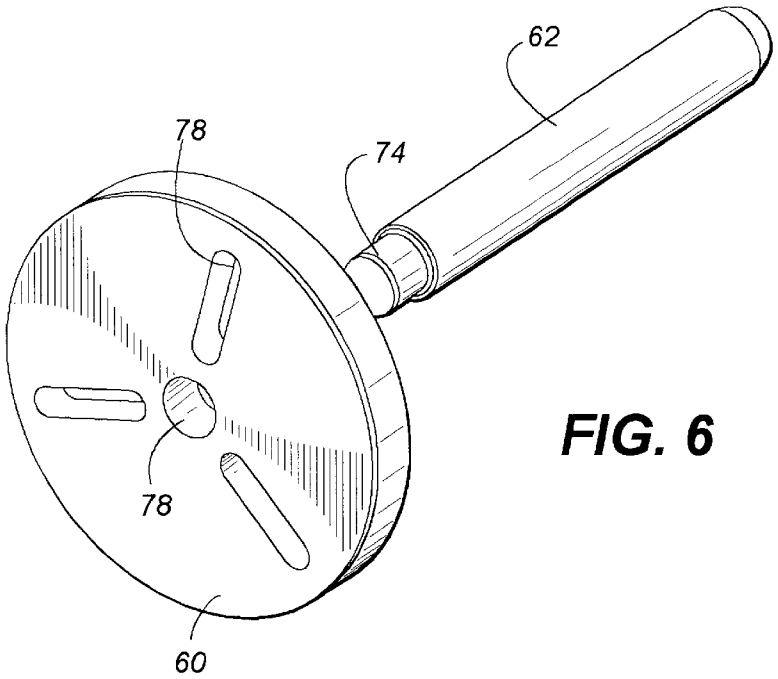
FIG. 6 is an exploded view of the mounting plate illustrated in FIG. 2.

FIG. 6 is an exploded view of the mounting plate 60 and mounting plate shaft 62. Both the mounting plate 60 and the mounting plate shaft 62 are preferably composed of steel, although other materials may be used. The mounting plate shaft 62 has a cylindrical shape that tapers to a narrow diameter near its bottom surface. An upper rod 74 of the mounting plate shaft 62 engages a bore 78 of the mounting plate 60 using a press fit. Once press fit together, the two pieces 60, 62 are welded together along the upper surface of the mounting plate 60. The mounting plate shaft 62 engages the cylindrical bore 47 in the clamp head 43. When unlocked, the height of the mounting plate 60 may be adjusted by moving the mounting plate shaft up or down within the bore 47.

Figure 7:
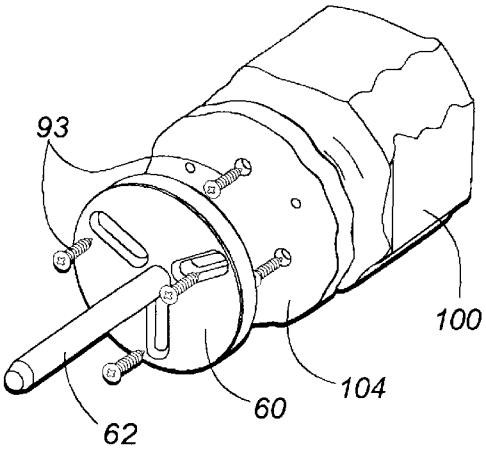
FIG. 7 is a bottom perspective view of the mounting plate illustrated in FIG. 2.

The mounting plate 60 is a cylindrical steel plate containing a plurality of oval slots 78. The slots extend from a position near the center of the plate 60 to a position near the circumference of the plate 60. The slots are designed to receive fasteners for attaching the mounting plate 60 to a workpiece. As shown in FIG. 7, fasteners 93 pass through slots 78 to engage a workpiece 100 directly, or to engage an intermediate piece of wood 104. The intermediate wood mount 104 may be used if the carver intends to change among several workpieces often.

Figure 9:
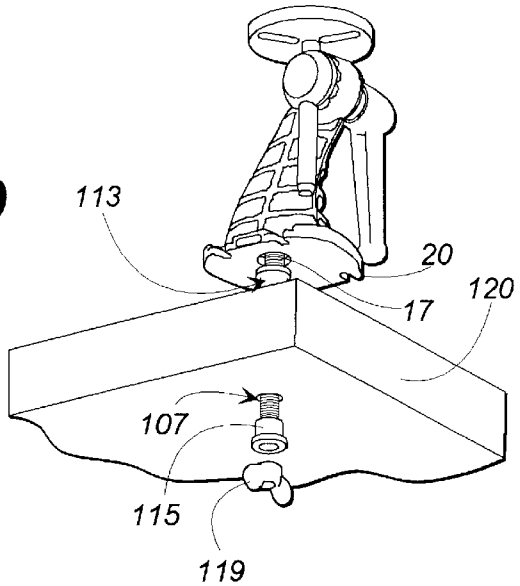
FIG. 9 is an illustration of the vise of the present invention coupled to a top of a workbench using a central bore.
Figure 8:
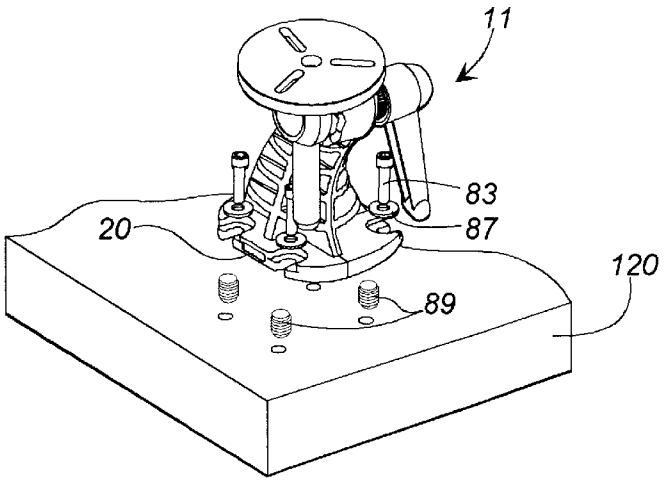
FIG. 8 is an illustration of the vise of the present invention coupled to a top of a workbench using fasteners.

The vise 11 may be affixed to a workbench as shown in FIGS. 8 and 9. In FIG. 8, the vise is coupled to the workbench using a plurality of fasteners 83. The fasteners 83 are inserted through recesses 14 formed into the mounting portion 12 of the base 20. Washers 87 are placed between the heads of the fasteners and the recesses 14. The fasteners 83 are then threaded directly into the workbench 120 or into threaded inserts 89 placed into mounting holes in the workbench 120. The inserts 89 allow the vise 11 to be removed and replaced often without stripping the holes in the workbench. In addition, the inserts allow the vise base 20 to contact a flush surface.

FIG. 9 shows the vise 11 coupled to a workbench using the central bore 17 located in the mounting portion 12. To affix the vise using the central bore 17, a threaded rod 107 engages a dog hole located in the workbench 120. The rod 107 is stabilized within the workbench 120 by an upper bushing 113 and a lower bushing 115. The lower bushing is further secured by a wing nut 119. Once the rod 107 is in place, the central bore 17 is threaded onto the rod until the base 20 is flush with the surface of the workbench 120.

To operate the vise 11, the user affixes the vise 11 to a workbench using the methods described above. A workpiece is then attached to the mounting plate 60 using fasteners guided through the slots 78 of the mounting plate 60. The clamping mechanism 30 is then unlocked to permit rotation and translation of the mounting plate 60. The clamping mechanism 30 is unlocked by rotating the handle 55 such that the handle 55 moves away from the base connector 35. As the handle 55 moves away, forces placed on the spring 70 are lessened. In addition, the clamp head 43 is removed from a firm position against the base connector 35.

When the clamp head 43 is not held firmly against the base connector 35, the mounting plate 60 and mounting plate shaft 62 are free to move. As illustrated in FIG. 1, the mounting plate can rotate and translate about and through several axes. First, the mounting plate 60 may rotate about an axis formed by the mounting plate shaft 62. This direction is indicated by arrows 130. Second, the mounting plate 60 may rotate about an axis formed by the clamp shaft 46 of the clamp 40. This direction is indicated by arrows 140. As discussed above, rotation in the direction 140 may be performed in 30° increments by moving the clamp shaft 62 to various grooves in the base connector 35. Finally, the mounting plate 60 and shaft 62 may move up and down within the bore 47 in the clamp head 43, thus translating through an axis passing through the mounting plate shaft 62. The spring 70 assists in holding the mounting plate shaft in position without completely releasing. In addition, the spring 70 pulls the mounting plate shaft 62 into the grooves when it is moved to a new groove. This action provides positive feedback to the user as to the location of the mounting plate shaft 62.

The vise may also be mounted to a side of the workbench. While mounted along the side of the workbench, the vise remains operable as described above. Specifically, the clamp 40 may be released to allow the mounting plate 60 to rotate about an axis formed by the clamp shaft 46. Thus, the mounting plate 60 and the workpiece may be held in an upright position. The mounting plate 60 may also be moved to allow the workpiece to rotate about the mounting plate shaft 62 and vertically through the bore 47 in the clamp head 43.

Having thus described a preferred embodiment of a carver's vise, it should be apparent to those skilled in the art that certain advantages have been achieved. It should also be appreciated that various modifications, adaptations, and alternative embodiments thereof, including mounting the vise 11 in a sliding tail vise of a workbench for example, may be made within the scope and spirit of the present invention. The invention is further defined by the following claims:

What is claimed is:

1. A vise for holding a workpiece, the vise comprising:

a base having a portion angled from a rear of the base upward to a front of the base;

a base connector coupled to the base;

a releasable clamp mechanism having a clamp head and a clamp shaft coupled to the base connector, the clamp shaft being disposed in a bore in the base connector;

a handle mounted on the clamp shaft;

a mounting plate shaft disposed through a bore in the clamp head;

a mounting plate coupled to the mounting plate shaft, the mounting plate being rotatable about two axes and translatable along one of the two axes;

a plurality of grooves forming discrete angles located on the base connector for receiving the mounting plate shaft to alternatively position the mounting plate shaft at the discrete angles; and a friction-increasing component contacting the clamp head and the mounting plate shaft.

2. The vise, as recited in claim 1, wherein the base connector is integrally formed with the base.

3. The vise, as recited in claim 1, further comprising an energy storing mechanism disposed proximate the clamp shaft.

4. The vise, as recited in claim 1, wherein the base may be mounted to a side surface of a workbench.

5. The vise, as recited in claim 1, wherein one of the axes of rotation is the mounting plate shaft.

6. The vise, as recited in claim 1, wherein one of the axes of rotation is the clamp shaft.

7. The vise, as recited in claim 1, wherein the discrete angles are 30 degrees with respect to each other.

8. The vise, as recited in claim 1, wherein the friction-increasing component comprises an O-ring disposed around the clamp head and proximate the mounting plate shaft.

9. The vise, as recited in claim 1, wherein the mounting plate shaft translates through an axis passing through the clamp shaft head.

10. The vise, as recited in claim 1, wherein the angled portion of the base includes a plurality of ribs extending along first and second sides of the base.

11. The vise, as recited in claim 1, wherein the mounting plate comprises a plurality of apertures through which fasteners may be passed into the base of a workpiece.

12. The vise, as recited in claim 11, wherein the plurality of apertures comprise elongated slots.

13. The vise, as recited in claim 1, wherein rotation of the handle in a first direction draws the clamp head toward the base connector and rotation of the handle in a second direction moves the clamp head away from the connector.

* * * * *